US005630739A

United States Patent [19]

Mele

[11] Patent Number: 5,630,739

[45] Date of Patent: May 20, 1997

[54] FORWARD-FACING ROWING

[76] Inventor: Peter C. Mele, P.O. Box 533, Crown Pt, N.Y. 12928

[21] Appl. No.: 611,464

[22] Filed: Mar. 4, 1996

[51] Int. Cl.[6] ..... B63H 16/04

[52] U.S. Cl. ..... 440/102

[58] Field of Search ..... 440/102, 103, 440/104

[56] References Cited

U.S. PATENT DOCUMENTS 4,623,314 11/1986 Waugh ..... 440/104

5,127,859 7/1992 Rantilla ..... 440/104

*Primary Examiner*—Jesus D. Sotelo

*Attorney, Agent, or Firm*—George E. Kersey, Esq.

[57] ABSTRACT

An oar mounting system for forward-facing rowing in which an arm or pulley strut is hinged to a support or gunwale frame, with an end of the arm extending from the frame and rotationally mounting an auxiliary or inner oar frame to which an oar loom is attached and the auxiliary frame is tensioned with respect to the arm. The tensioning is by a cable that extends from a terminal post on the auxiliary frame around a pulley at the end of the arm and around a further pulley hinged to the support frame.

20 Claims, 11 Drawing Sheets

FORWARD-FACING ROWING

BACKGROUND OF THE INVENTION

This invention relates to forward-facing rowing, and more particularly, to forward-facing rowing in which a structurally integrated handle and blade loom is rotatable about a common sweep axis and includes provision for feathering the oar blade during the return stroke of the oarloom.

Forward-facing rowing has employed looms with two sections, for a handle loom and a structurally separate blade loom. The handle and blade looms have been hinged at an oarlock mainframe, each by a separate and generally vertical sweep hinge. The blade loom moves backwards when the handle loom moves backwards, and forward when the handle moves forward. This allows the oarsman to face forward.

Synchronized motion of the two oar looms has been achieved by using a slave linkage, such as that provided by crossover link rods, a pair of gear sectors, drums and cables. In some cases, sprockets and chains are used to interconnect the two oar loom sections. The oarlock mainframe is usually mounted on a horizontal teeter hinge that is oriented fore and aft of the hull centerline to permit raising and lowering the blade in relation to the water over which the boat is to be propelled. This complex articulated system is poorly adapted to the feathering of the oar blades by the handle twisting which has been a requirement for high performance rowing in racing shells.

During feathering the oar blades are rotated to flatten them horizontally by turning hand grips so that on the return stroke the face of the blade will be substantially parallel to the surface of the water. This reduces wind resistance and forces the blade, if in contact with the water, to ride on the surface rather than dig in and interrupt a smooth return stroke for the rowing cycle.

In conventional rearwards facing feathering, the oarsman lowers his wrists to bring the moving top edge of the oar blade forward to present the blade in an upwards slanted direction allowing it to ride over the water surface. However, in forwards facing rowing, the oarsman sits behind, rather than ahead of, the oar handles as in the case in conventional rearwards facing rowing. As a result, should the oarsman lower his wrists to feather, the lower edge of the oar blade would possibly hit the water. This would carry the oar beneath the surface of the water and completely disrupt the stroke and possibly break the oar or injure the oarsman.

In conventional rowing, the oarsman is trained to drop his wrists to feather the blades. This motion is the best way to achieve feathering since the wrists will be straight for pulling the oarloom during the power stroke. It is desirable to rotate the handle in a direction opposite to that of the blades in order to achieve feathering in forward facing rowing. The feathering mechanism also acts as a safety device. If the oar catches the water on the return stroke, it will automatically feather when pushed forwardly.

It also is desirable in forward facing rowing for the feathering to produce as little friction as possible. The oarsman holds oar handles with his bare hands, which should not become blistered or over fatigued by feathering. Low friction is desirable in that oars are usually feathered almost automatically due to water resistance when they are reversed for a return stroke.

One attempt to facilitate forward facing rowing is disclosed in duPont U.S. Pat. No. 5,248,279 which issued Sep. 28, 1993 for "Forwards Facing Rowing Apparatus with Feathering of the Oar Blades". In this disclosure the usual pair of sweep hinges is replaced by a single common axis with the sweep hinge system rockable with an oar lock mainframe and the blade feathering is provided by coupling with a pair of swing gears at the oarset with one of the gears driven from a floating handle at the inboard end of a handle loom, while the mating gear drives or rotates the blade at the outer end of the blade loom. This system is mechanically complex with consequent possibility of failure during operation and substantial expense in both production and maintenance.

Accordingly, it is an object of the invention to facilitate forward facing rowing. A related object is to simplify the forward facing mechanisms that are conventionally associated with such rowing. A related object is to eliminate the need for the gearing and complexity associated with disclosures such as those of duPont U.S. Pat. No. 5,248,279.

SUMMARY OF THE INVENTION

In accomplishing the foregoing and related objects, the invention provides an oar mounting system for forward-facing rowing with a support or gunwale frame; an arm or pulley strut hinged to the support frame and having an inner end; an auxiliary or inner oar frame rotationally mounted on the inner end; an oar loom attached to the auxiliary frame; and means for tensioning the auxiliary frame with respect to the arm.

In accordance with one aspect of the invention, the oar mounting means for tensioning comprises a a cable or cord that extends from a terminal post on the auxiliary frame around a pulley at the inner end and around a further pulley hinged to the support frame. The support frame includes separated blocks between which the arm is hinged, and the cable is rotationally mounted on the first mentioned inner end pulley. The cable does not rotate or slip with respect to the pulley, since it lays on or off the pulley. The cable is connected by a turnbuckle to the terminal post of the auxiliary frame to permit a tension adjustment.

In accordance with another aspect of the invention the cable extends from the turnbuckle to the first mentioned inner end pulley and then around the hinged further pulley. The cable can extend into the first mentioned inner end pulley and into a groove thereof, extending therefrom around a groove in the hinged second pulley and then back around the first mentioned inner end pulley.

The cable can extend through a cylinder that is perpendicularly mounted at the periphery of the hinged further pulley and include a member for engaging the cable.

In accordance with a further aspect, the arm is mounted rotationally with respect to the hinged further pulley and is spring loaded by a member secured to a mount on the hinged further pulley. The oar mounting system can further include a boat to which the support frame is attached.

The invention also makes use of loading a spring during the return stroke for energy release during the power stroke. The return stroke energy storage can be varied by changing springs and the position at which the spring is engaged. Typically, the spring is engaged appropriately on the return stroke in a way that captures the momentum that has developed, unrelated to the return stroke spring. The leverage that is offered the oarsman may be increased for heavy loads and adverse weather conditions by changing gears, i.e. by transferring the control cable from a "high" gear to a "low" gear.

In accordance with yet another aspect of the invention, a compressible sleeve of suitable material, such as an elastomer or plastic, may be placed over the oar to allow and control loom rotation. In this arrangement, the sleeve encircles the oar and is controllably gripped by the hand of the oarsman.

In a method of the invention for forward-facing rowing, the steps include (a) hinging, to a support frame, a pulley having an outward side pulley that is rotationally mounted on a hinged pulley; (b) rotationally mounting an auxiliary frame on the inner end; (c) attaching an oar loom to the auxiliary frame; and (d) tensioning the auxiliary frame with respect to the arm. The tensioning can be by a cord that extends from a terminal post on the auxiliary frame around a pulley at the inward end and around a further pulley hinged to the support frame. The pulley arm can be hinged by way of a pulley to the support frame between separated hinge members and be rotationally mounted.

In accordance with a further aspect of the method, the cord is connected by a turnbuckle to the terminal post of the auxiliary frame to permit a tension adjustment of the cord. The cord can extend from the turnbuckle to the first mentioned pulley and then around the further pulley. The cord can extend into the first mentioned pulley and into a groove thereof, extending therefrom around a groove in the second pulley and then back around the first mentioned pulley. The cord also can extend through a cylinder that is perpendicularly mounted at the periphery of the further pulley and include a member for engaging the cord. Grooves in the outer pulley have notches to engage cable clamps.

In accordance with another aspect of the method, the arm is rotationally mounted with respect to the further pulley and is spring loaded by a member secured to a mount on the further pulley. The method of forward-facing rowing further includes attaching the support frame to a boat, with support frame having an outer pulley on a pulley strut with an inner pulley supporting an oar strut. A cable is connected between the inner and outer pulleys.

BRIEF DESCRIPTION OF THE DRAWINGS

Other aspects of the invention will become apparent after considering several illustrative embodiments taken in conjunction with the drawings, in which.

DETAILED DESCRIPTION

Figure 1:
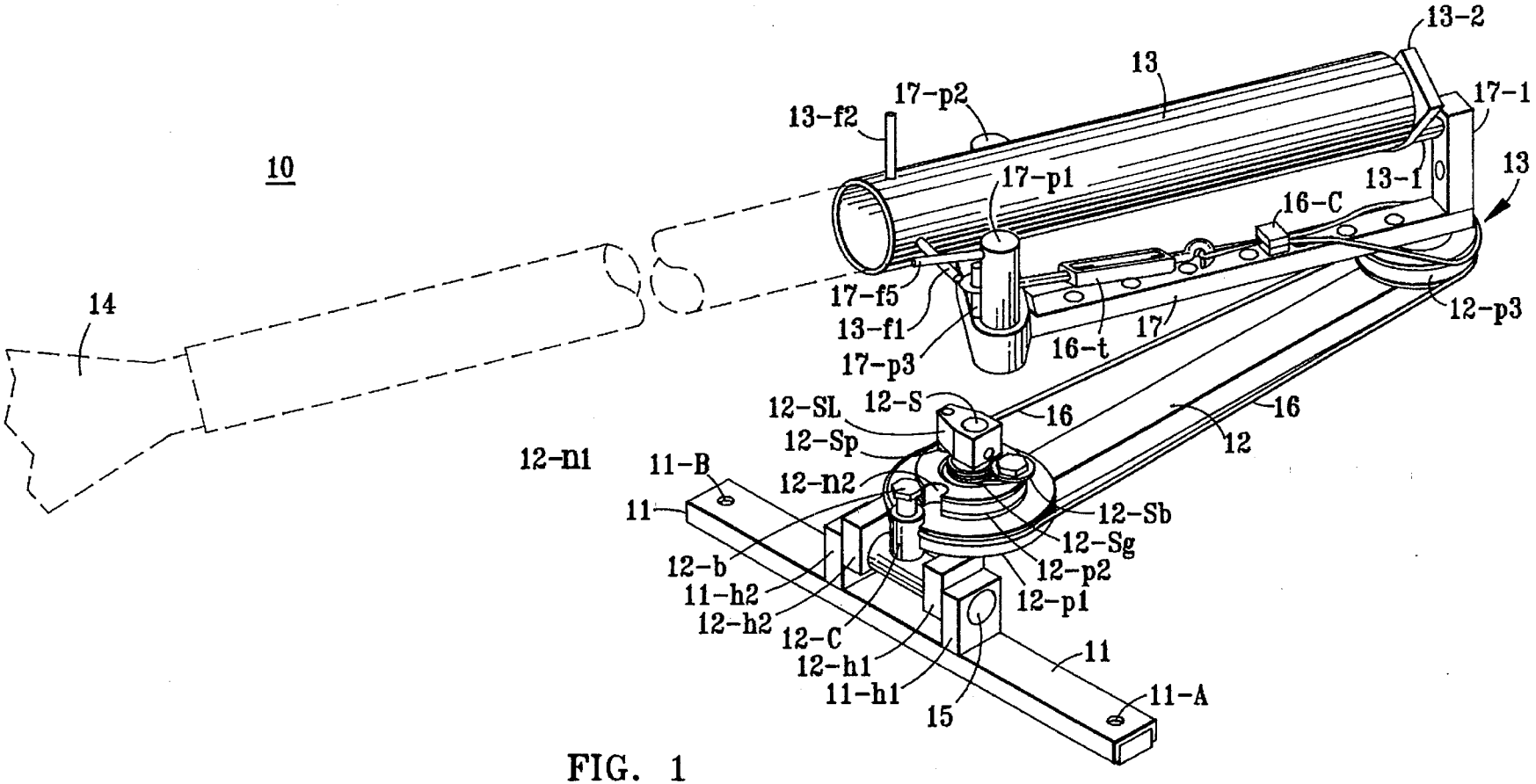
FIG. 1 is a perspective view of a forward-facing starboard-unit rowing device in accordance with the invention.

With reference to FIG. 1, a perspective view of a forward facing rowing device 10 in accordance with the invention includes a gunwale base or mainframe 11 to which is hinged pulleys **12-*p*1 and 12-*p*2, and rotationally mounted thereupon is a strut or arm 12 about which a loom or oar frame 13 is rotatable with an illustrative blade 14 (shown in phantom) insertable into the loom or oar frame 13**.

It will be understood that the gunwale base or mainframe 11 is conventionally secured to the upper edge or the side of a hull of a boat or skull that is to be rowed forwardly. The attachment of the mainframe 11 to the boat also can be on an outrigger (not shown) which extends outwardly from the hull in midsection between the fore and aft ends of the boat.

To attach the mainframe 11 to a boat or skull, bolt holes 11-A and 11-B are shown in FIG. 1, but the attachment may be made in any standard fashion, including the use of suitable adhesives. The mainframe 11 also includes gunwale blocks **11-*h*1 and 11-*h*2 between which are positioned blocks 12-*h*1 and 12-*h*2 of the pulley strut or arm 12. A pulley strut pivot or hinge pin 15 extends through the hinges 11-*h*1, *h*2, and 12-*h*1, *h*2**.

A high-gear outer pulley **12-*p*1 and a low-gear outer pulley 12-*p*2 are coaxially and rotationally mounted on the arm 12 by an outer pulley shaft 12-*s*. Both pulleys 12-*p*1 and 12-*p*2 contain respective cable clamp notches 12-*n*1 and 12-*n*2. As illustrated in FIG. 1, a cable 16 engages the high-gear pulley 12-*p*1 and passes through a cable clamp 12-*c* where it is held in the notch 12-*n*1 by a cable bolt 12-*b* that is threaded into the cable clamp 12-*c***.

It will be apparent that to change the cable to the low-gear pulley **12-*p*2, the clamp 12-*c* is moved to the notch 12-*n*2. The arm 12 is loaded by a spring 12-*sg* which encircles the pulley shaft 12-*s* and is secured to a spring clamping bolt 12-*sb*. Also secured to the pulley shaft 12-*s* is an adjustable return stroke spring leader 12-*sl* which includes a stop pin 12-*sp*. The spring 12-*s* restores the arm 12** to its equilibrium position after rotation.

An inner pulley **12-*p*3 is rotationally mounted at the opposite extremity of the arm 12 and is fixed to an inner oar mounting block or auxiliary frame 17 which has an upstanding end 17-1 for receiving a self-feathering pin or shaft 13-1 of the loom frame 13. The shaft 13-1 is accompanied by an adjustable off-set or self-feather plate 13-2. The inner oar mounting block or auxiliary frame 17 includes outer oar posts 17-*p*1 and 17-*p*2, with 17-*p*1 and the tip of 17-*p*2 visible in FIG. 1**.

The outer oar post 17-*p*1 includes a projecting feathering stop 17-*fs* for feathering pins 13-*f*1 and 13-*f*2. A turnbuckle or oar support post 17-*p*3 is positioned between the limit posts 17-*p*1 and 17-*p*2 and serves the cable 16 as the attachment end of a turn buckle 16-*t* that extends from the post 17-*p*3 to a cable clamp 16-*c*, from which the cable 16 extends through the the inner pulley 12-*p*3, around one of the outer pulleys, which is around the high-gear pulley 12-*p*1 in FIG. 1, then back to a groove of the inner pulley 12-*p*3, returning to the cable clamp 16-*c*.

The cord or cable 16 provides suitable tensional torque, by way of the pulleys, on the loom 13 to facilitate the desired rowing motions associated with the forward facing propulsion of the associated boat.

Figure 2:
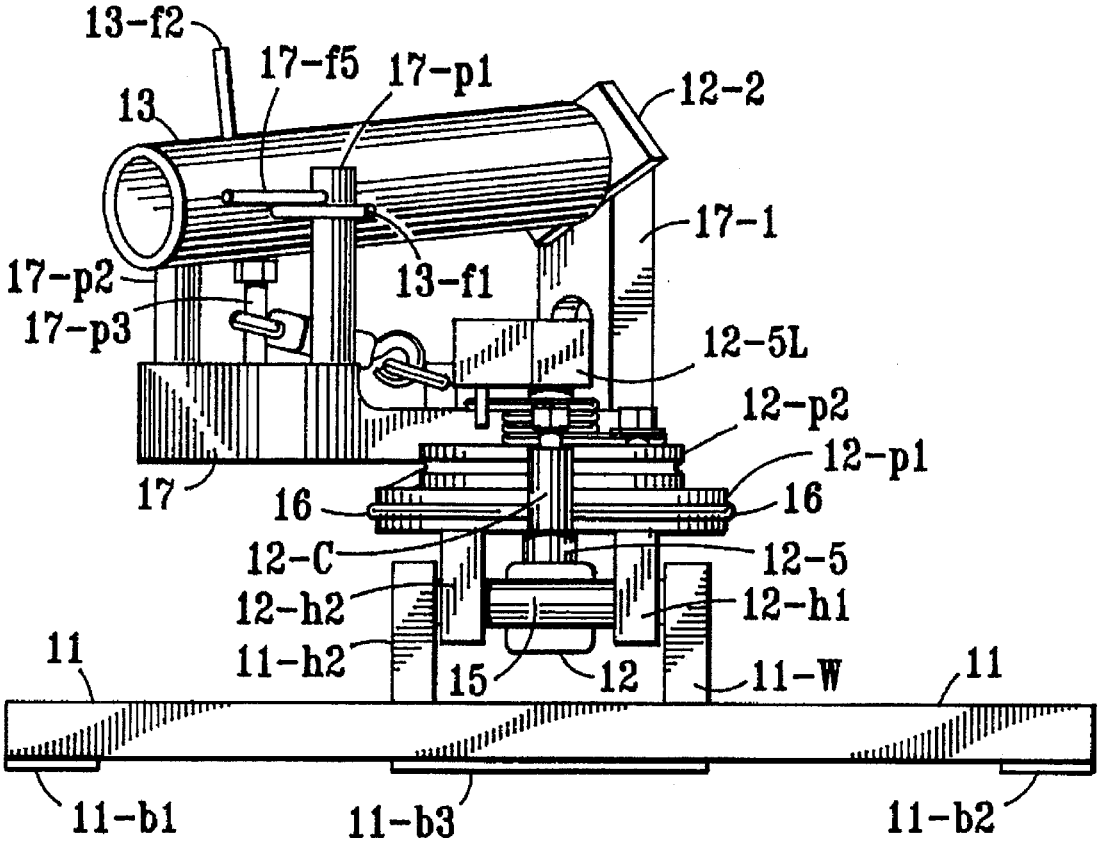
FIG. 2 is a outer side elevational view of the forward-facing rowing device of FIG. 1.

FIG. 2 is an outer side elevational view of the forward-facing rowing device of FIG. 1 best showing the spring return and details for the connection of the turnbuckle 16-*t* to the turnbuckle post and oar support 17-*p*3 in relation to the oar posts 17-*p*1 and 17-*p*2. Also detailed is the pulley strut or arm 12 in relation to the outer pulley shaft 12-*s* and the cable clamp 12-*c*. The gunwale base 11 is shown with mounting blocks 11-*b*1 through 11-*b*3.

Figure 3:
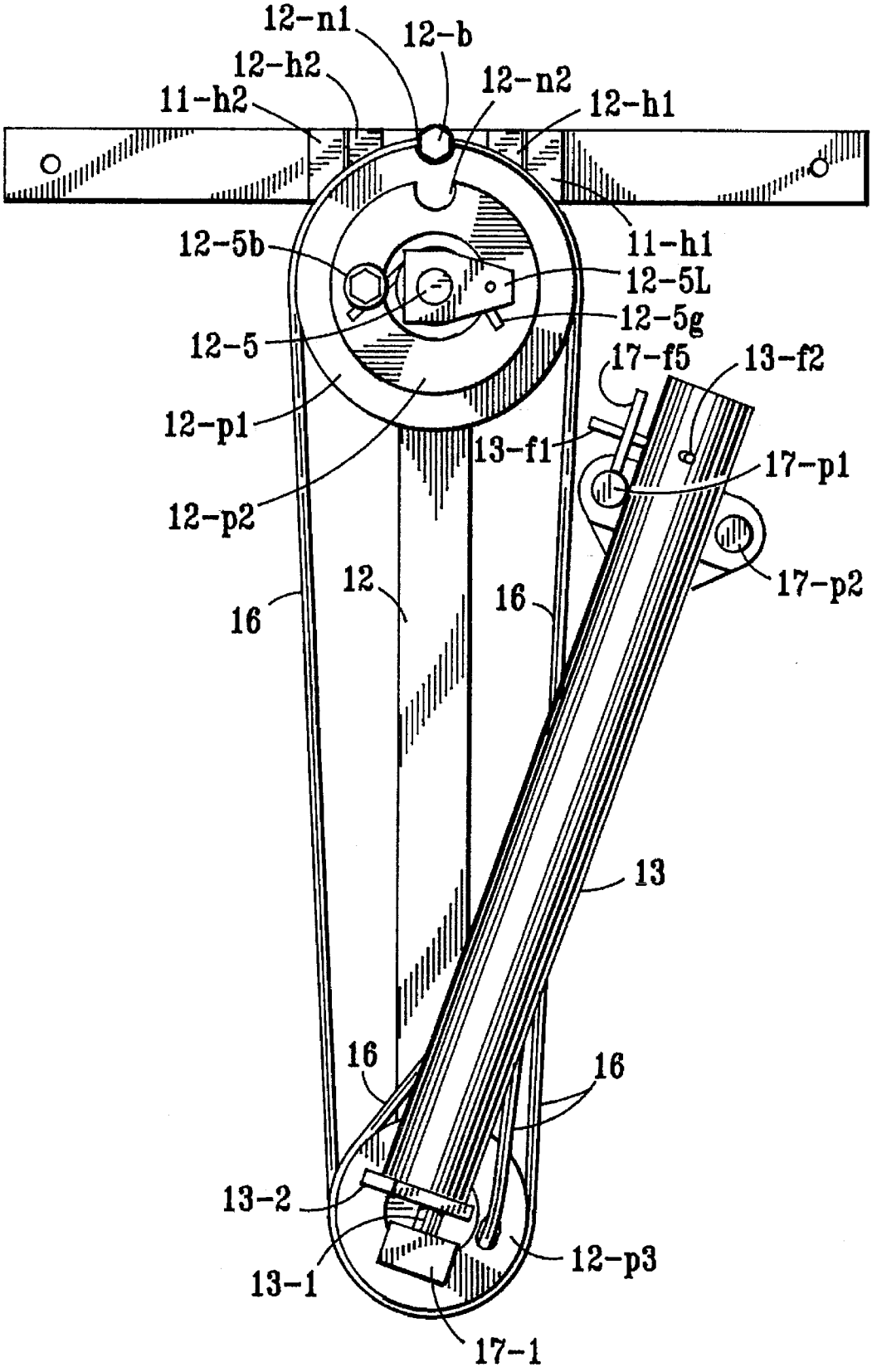
FIG. 3 is a top view of the forward-facing rowing device of FIG. 1.

In top view of FIG. 3 for the forward facing rowing device of FIG. 1 details are shown for the entry of the cord or cable 16 into the inner pulley 12-*p*3. Also indicated by the arrows on the cable 16 is one loop of the cable from the turnbuckle to its return as indicated in FIG. 4.

Figure 4:
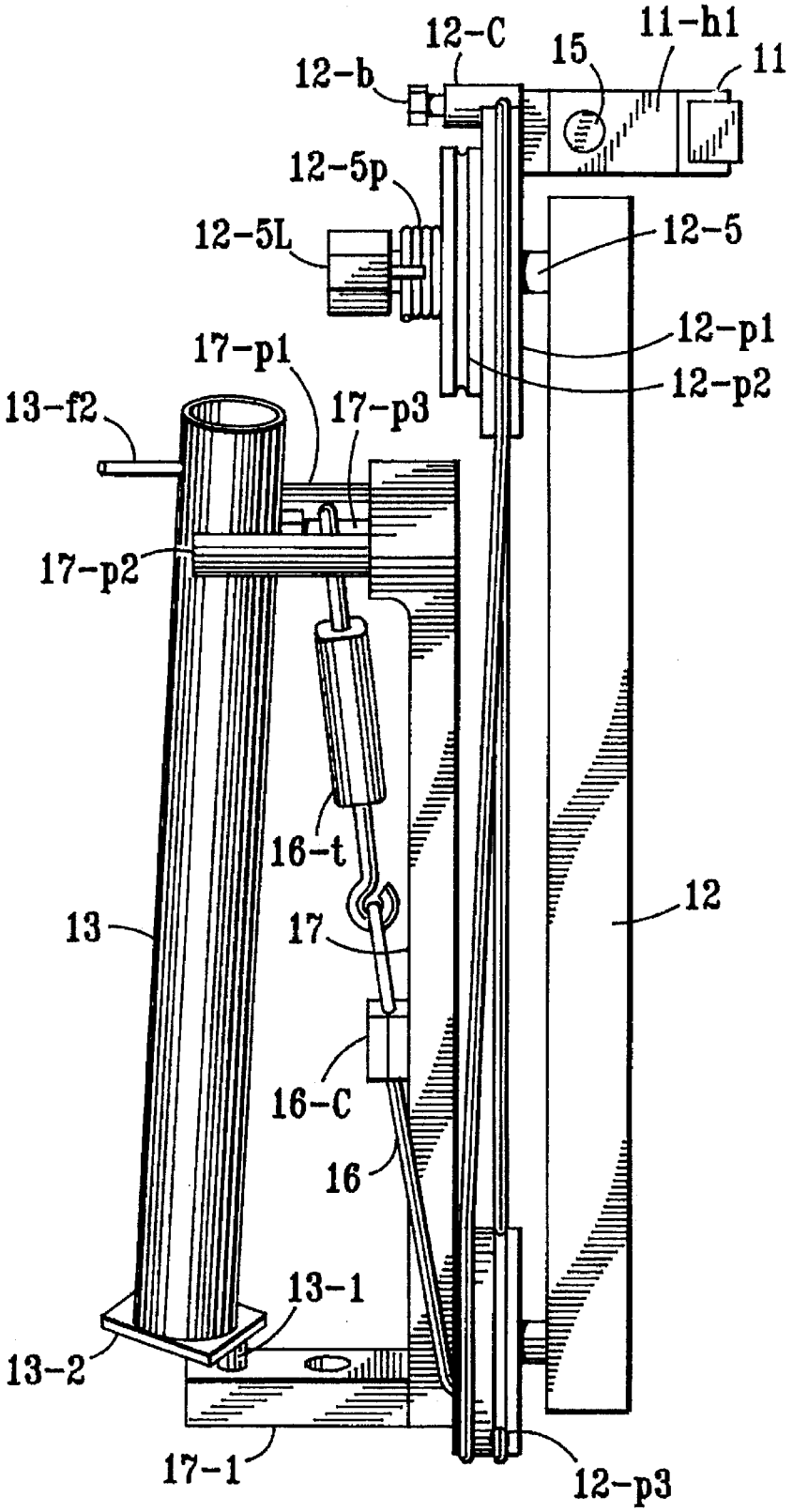
FIG. 4 is a lateral side or rear-end elevational view of the forward-facing rowing device of FIG. 1.
Figure 5:
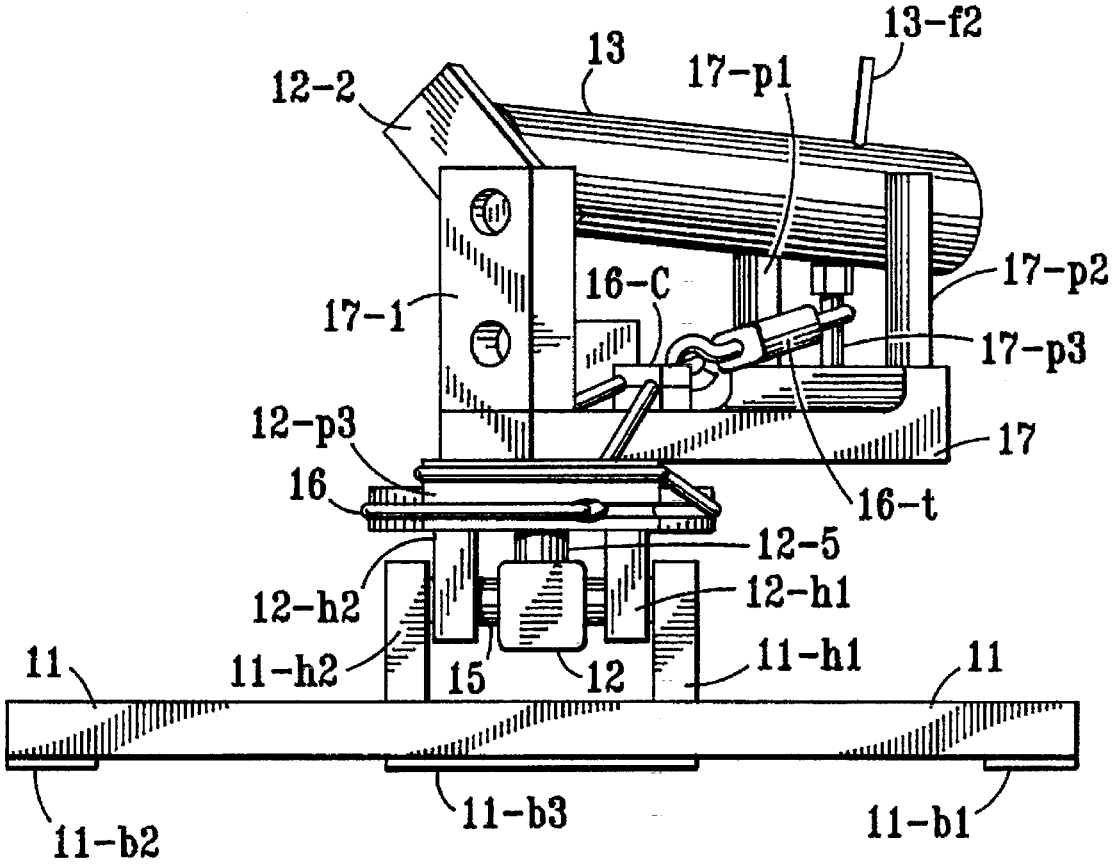
FIG. 5 is an inner side elevational view of the forward-facing rowing device of FIG. 1.
Figure 6:
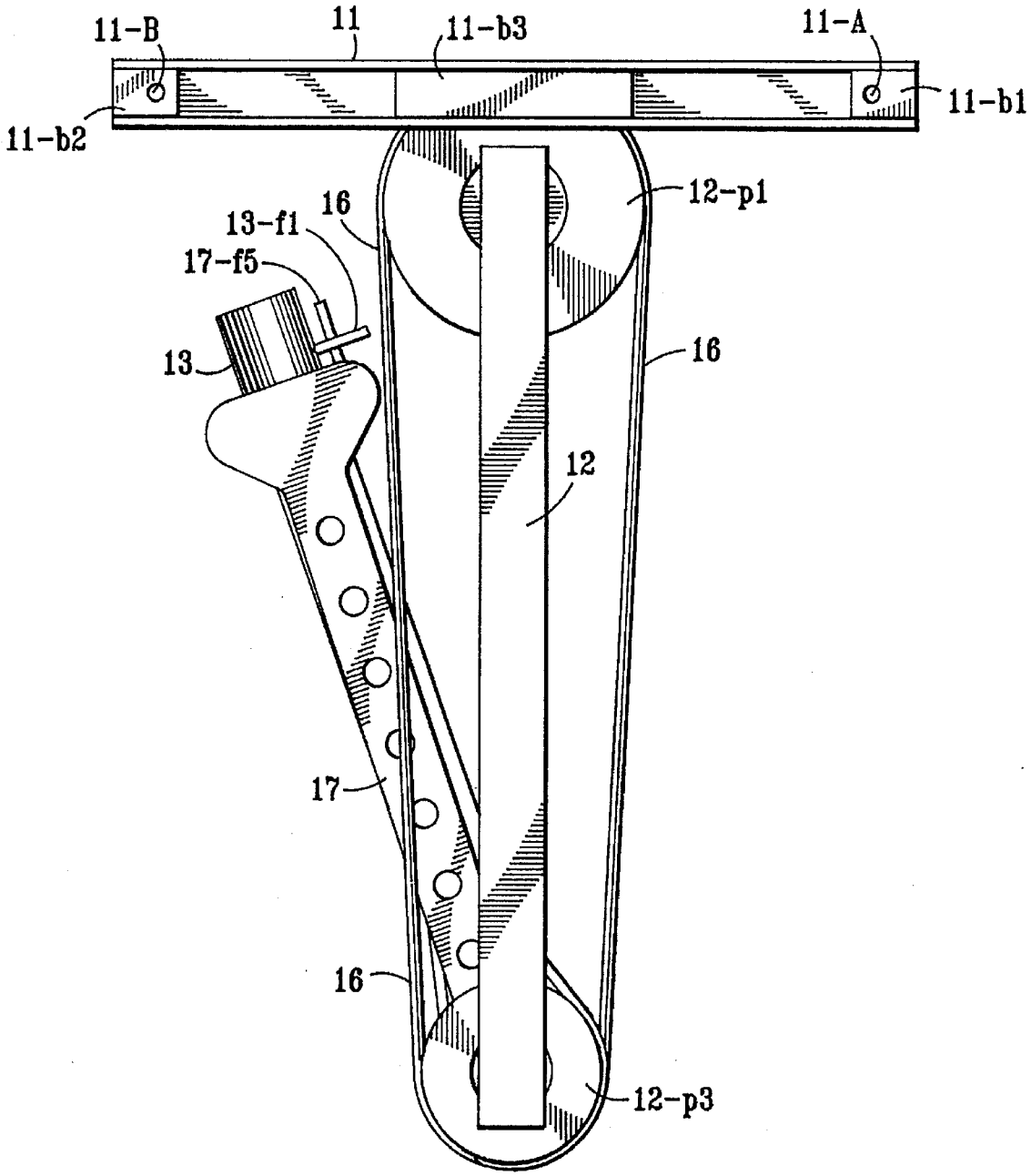
FIG. 6 is a bottom view of the forward-facing rowing device of FIG. 1.

Further details are pictured in the lateral rear-end elevational view FIG. 4 for the forward facing rowing device of FIG. 1; the inside-out side elevational view of FIG. 5 and the bottom view of FIG. 6.

Figure 7:
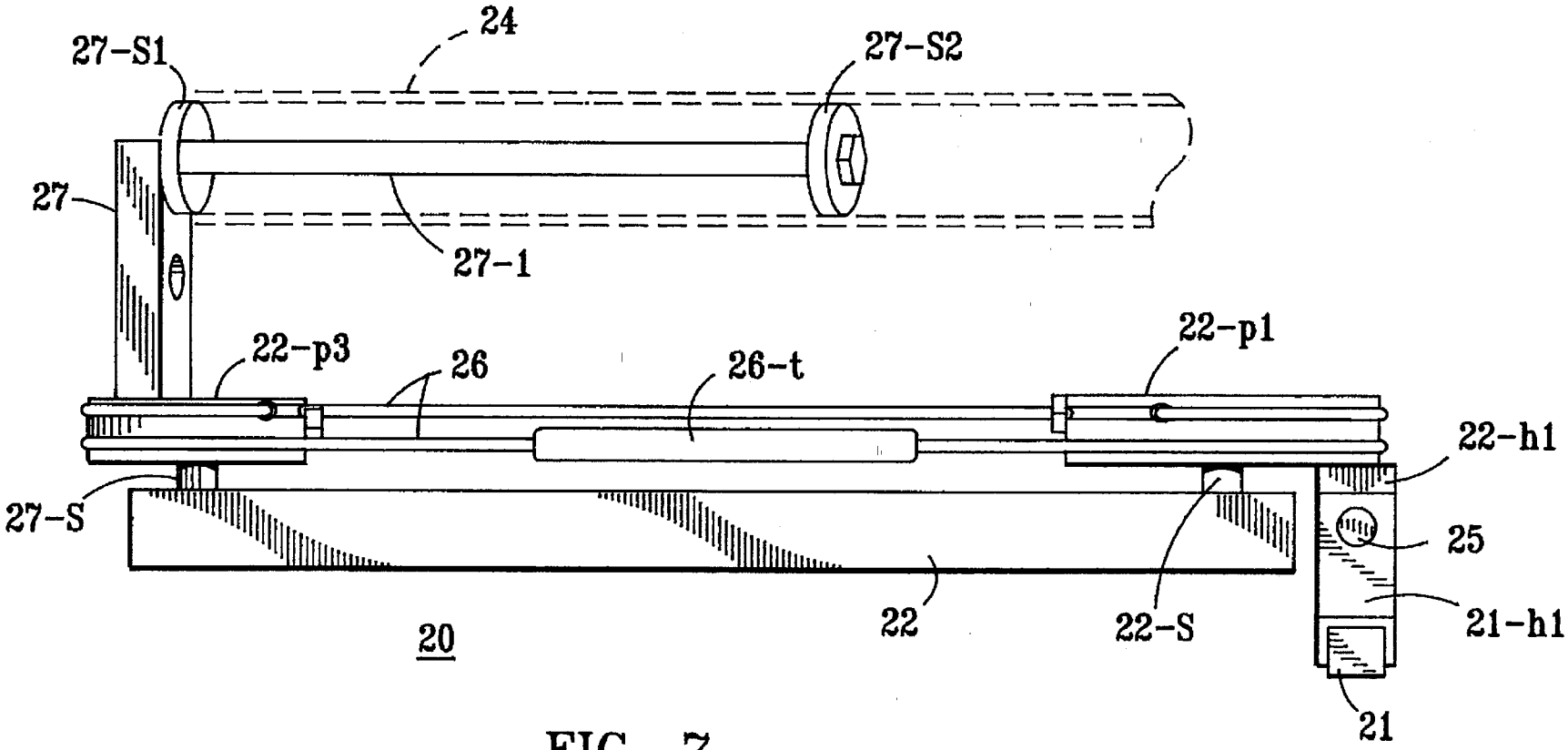
FIG. 7 is a rear-end elevational view of an alternative forward-facing rowing device of the invention.
Figure 8:
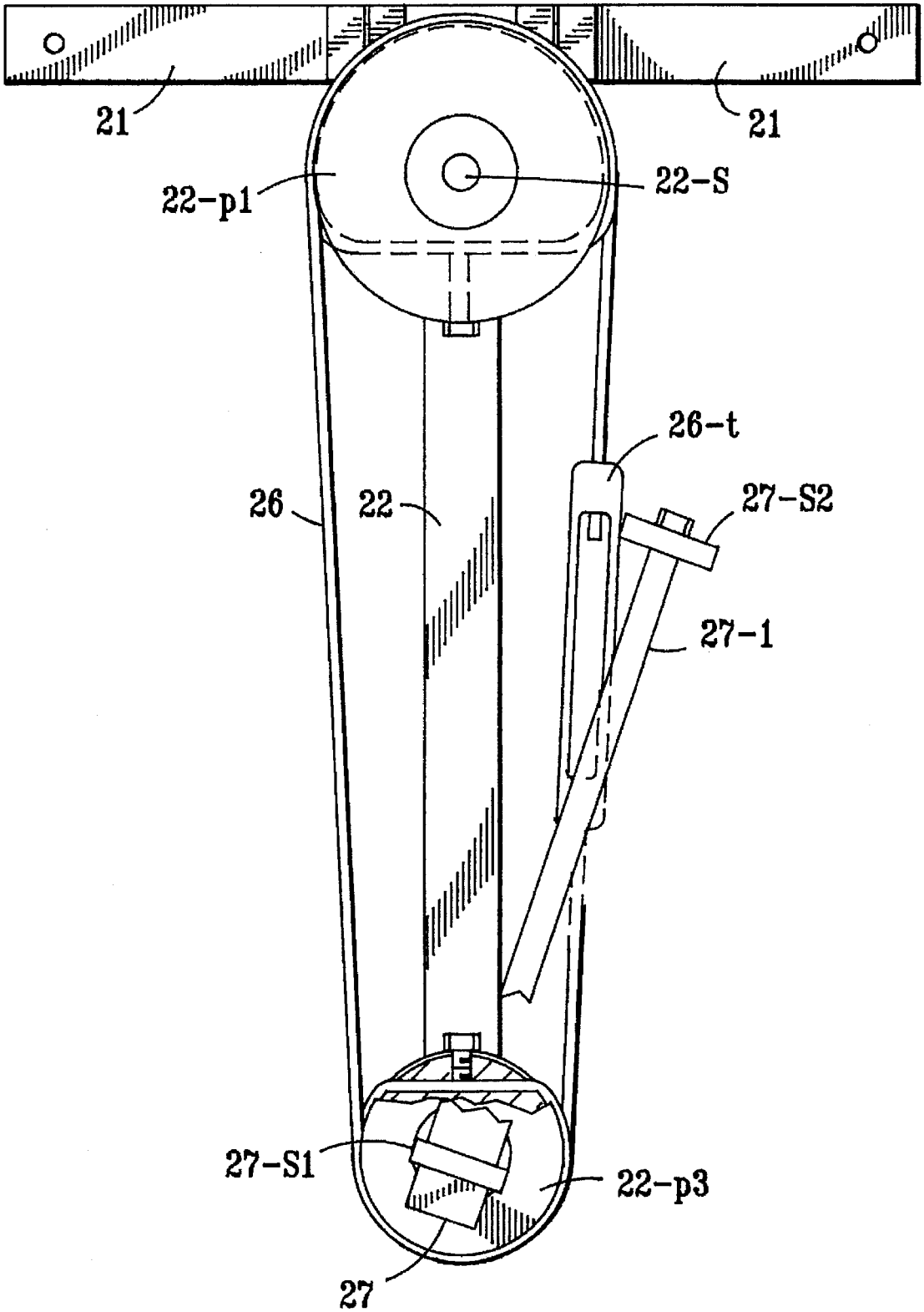
FIG. 8 is a top view of the forward-facing rowing device of FIG. 7.

With reference to FIGS. 7 and 8, an alternative forward-facing rowing device 20 in accordance with the invention includes a gunwale base or mainframe 21 which is hinged to a pulley about which rotates strut or arm 22. A loom or oar frame 27 is rotatable about the arm 22, with an illustrative shaft 23 (shown in phantom) insertable around an extension 27-1 of the loom or oar frame 27.

The mainframe 21 also includes gunwale hinge blocks 21-*h*1 and 21-*h*2 between which are positioned blocks 22-*h*1 and 22-*h*2 of the pulley strut or arm 22. A pulley strut pivot or hinge pin 25 extends through the hinges 21-*h*1, *h*2, and 22-*h*1, *h*2.

An outer pulley 22-*p*1 fixed to hinge blocks is rotationally mounted on the arm 22 by an outer pulley shaft 22-*t*. As illustrated in FIGS. 7 and 8, a cable 26 engages the pulleys 22-*p*1 and 22-*p*3, and is held by respective setscrews 22-*s*1 and 22-*s*2. In FIG. 8 the oar strut 27-1 (and the oar frame 27) are shown rotated away from the plane of the set-screw for clarity. In practice, the oar strut 27-1 and the set-screw are in the same plane.

The oar 23 is positioned over, and rotates about, supports 27-*s*1 and 27-*s*2 on the extension 27-1. The support 27-*s*2 is rotatable on an extension shaft which allows rotation of the oar shaft for feathering. A turnbuckle 26-*t* is included in the locus of the cable 26 that extends around the pulleys 22-*p*1 and 22-*p*3. The cord or cable 26 provides suitable tension on the pulleys to facilitate the desired rowing motions associated with the forward facing propulsion of the associated boat.

Figure 9:
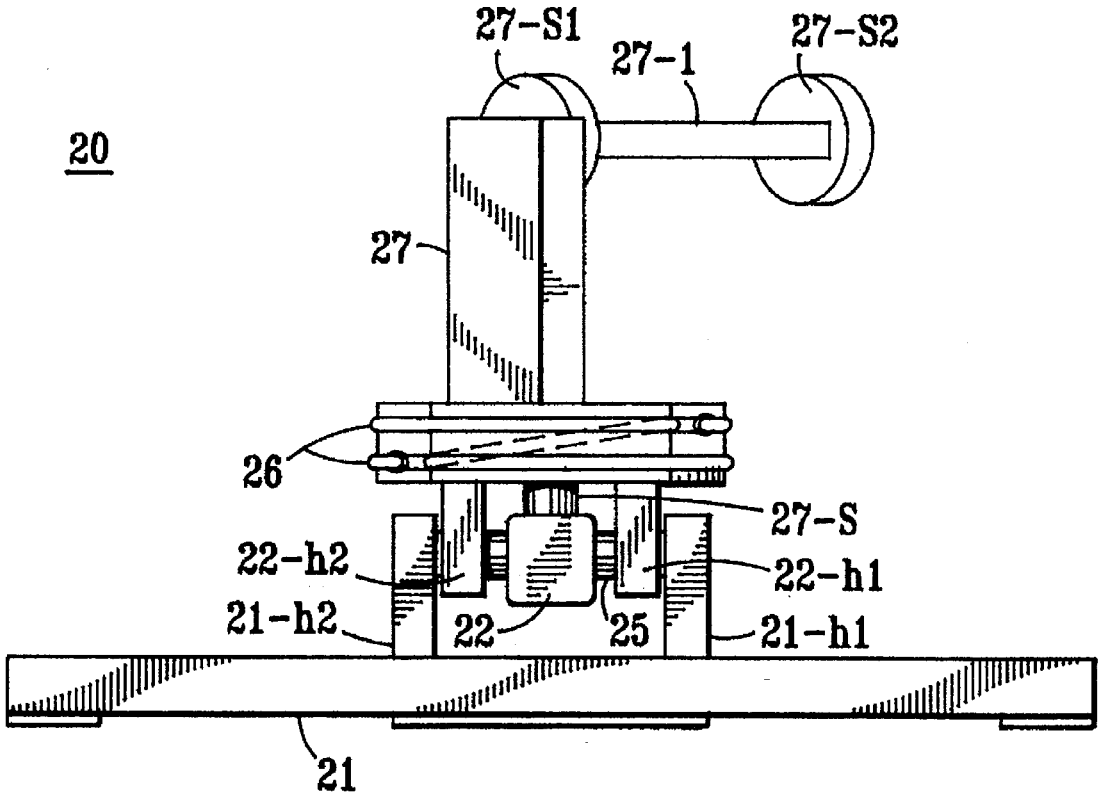
FIG. 9 is a side view of the forward-facing rowing device of FIG. 7.

FIG. 9 is an inside-out elevational view of the forward facing rowing device of FIGS. 7 and 8 showing details for the connection of the pulley strut or arm 22 in relation to the inner pulley shaft and the gunwale base 21. Details are also shown for the cord or cable 26 into the inner pulley 12-*p*3. Also indicated by the arrows on the cable 26 is one loop of the cable from the turnbuckle to its return.

Further details are pictured in the lateral rear elevational view FIG. 4 for the forward facing rowing device of FIG. 1; the inside-out side elevational view of FIG. 5 and the bottom view of FIG. 6.

Figure 10:
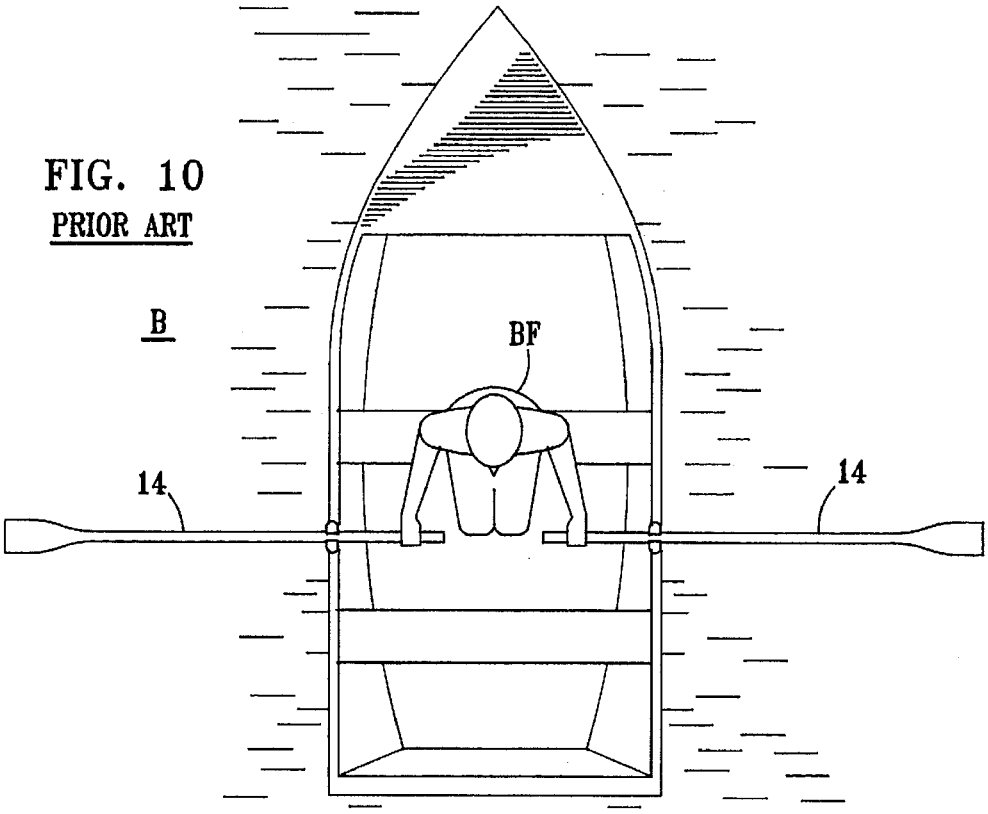
FIG. 10 PRIOR ART
FIG. 10 is a top view of a boat which is rowed in conventional fashion by a backward-facing rower.
Figure 11:
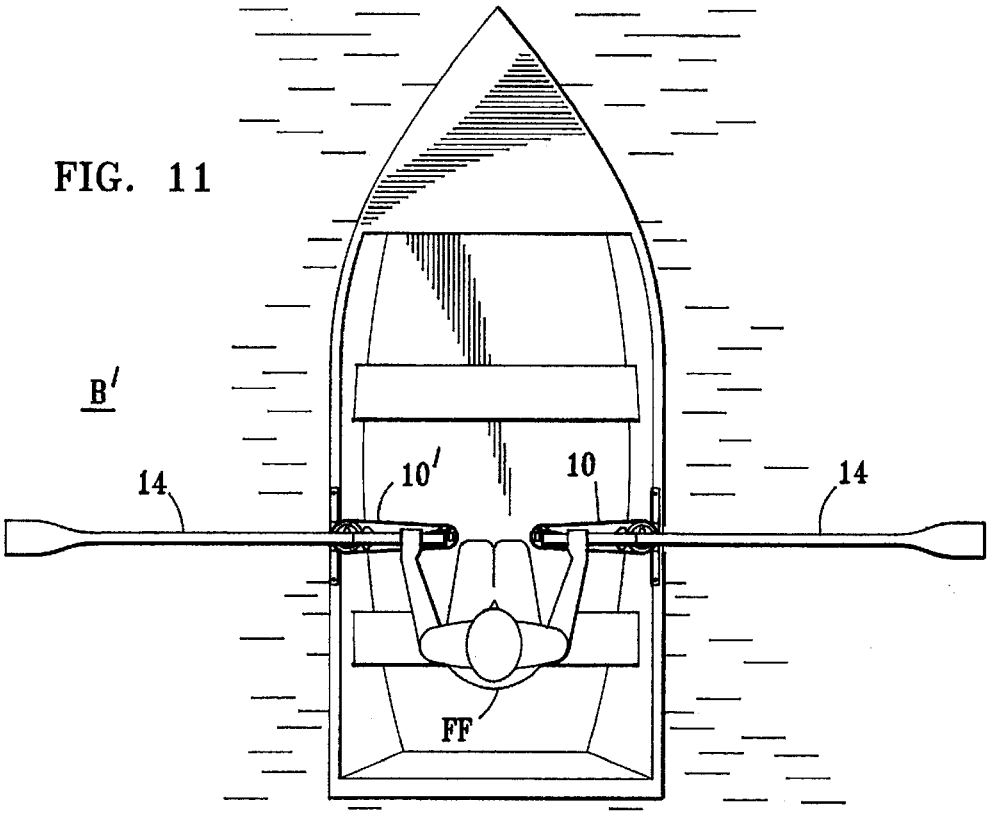
FIG. 11 is a top view of a boat which is rowed in accordance with the invention by a forward-facing rower.

With reference to FIGS. 10 and 11, the contrast is illustrated between ordinary backward-facing rowing and the forward-facing rowing of the invention. FIG. 10 is a top view of a boat B which is rowed in conventional fashion by a backward-facing rower BF using a pair of oars 14.

By contrast, FIG. 11 is a top view of a boat B' which has been modified with devices 10 and 10' in accordance with the invention to be rowed in accordance with the invention by a forward-facing rower FF.

Figure 12A:
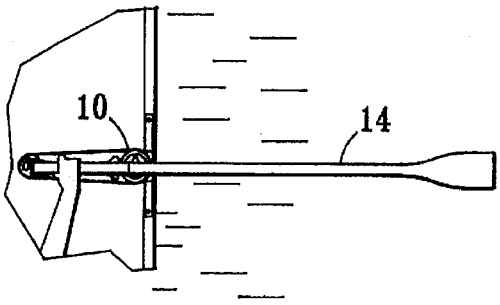
FIG. 12A is a fragmentary top view of the starboard side of FIG. 11 showing the device of FIG. 1 being used with a starboard-side oar in a starting position.
Figure 12B:
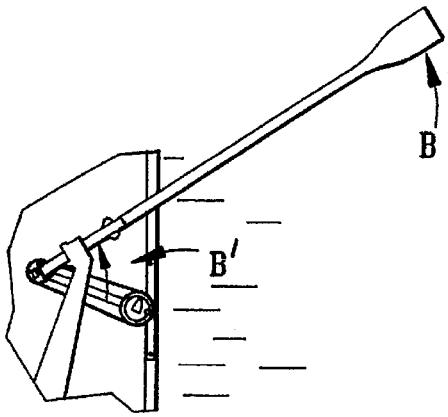
FIG. 12B shows the device of FIG. 1 being used with the starboard-side oar of FIG. 12A in a forward position preparatory to water contact.

The rowing procedure is illustrated in FIGS. 12A through 12F. Beginning with FIG. 12A, the fragmentary top view of the starboard side of FIG. 11 shows the device 10 of FIG. 1 being used with a starboard-side oar 14 in a starting position. To commence a forward-rowing stroke, the oar is moved as indicated in FIG. 12B by the arrows B' and B to a forward position preparatory to water contact.

Figure 12C:
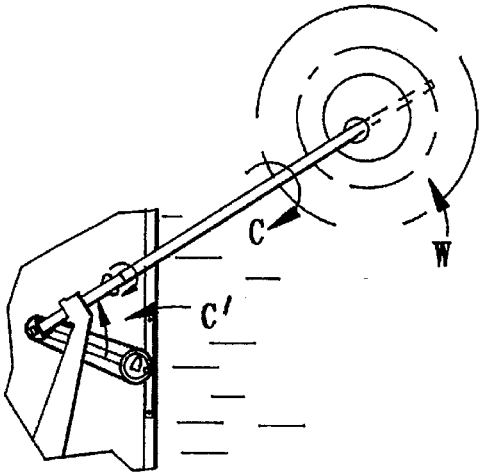
FIG. 12C shows the starboard-side oar of FIG. 12B in a forward position being unfeathered and inserted into the water for the beginning of a rowing stroke.

Once in a forward position, the oar is unfeathered as indicated in FIG. 12C, i.e. rotated as indicated by the arrows C' and C to move the blade of the oar from a position relatively parallel to the surface of the water W to a propulsion position where the oar is in the water with the blade perpendicular to the water surface for the beginning of a rowing stroke. The oar is rotated in a backward direction, looking from the inside end.

Figure 12D:
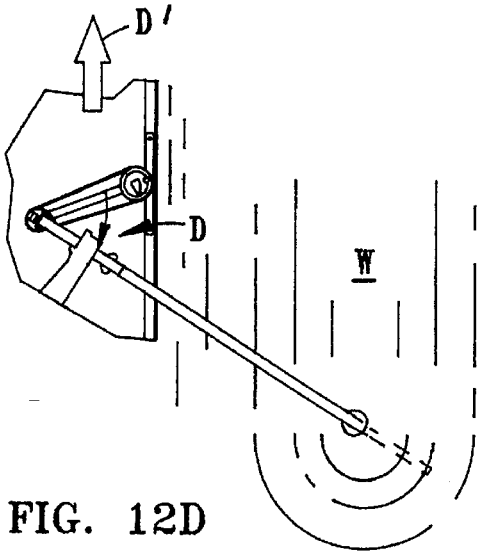
FIG. 12D shows the starboard side oar of FIG. 12C in a rowing stroke that propels the boat forwardly.

As indicated in FIG. 12D, the ensuing rowing stroke indicated by the arrow D propels the boat forwardly in the direction D'. Upon completion of the rowing stroke, the oar is removed from the water as indicated in FIG. 12E.

Figure 12E:
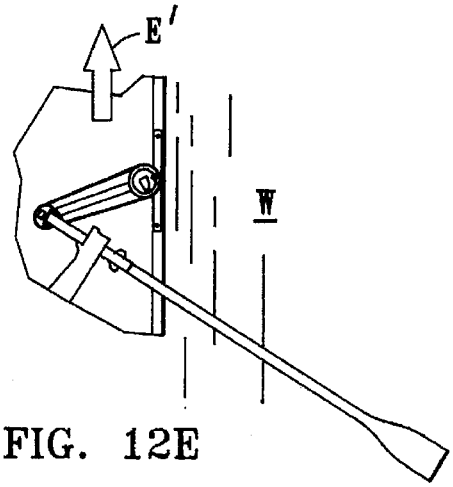
FIG. 12E shows the starboard-side oar of FIG. 12D after removal from water contact and feathering after completion of the stroke.
Figure 12F:
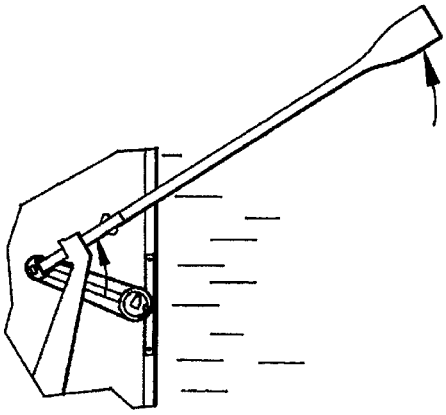
FIG. 12F shows the starboard side oar of FIG. 12E after being moved to the forward position of FIG. 12B following completion of the stroke as indicated in FIG. 12E.

Finally, as indicated in FIG. 12F, the starboard side oar of FIG. 12E is moved to the forward position of FIG. 12B for the commencement of another rowing stroke. The actions indicated on the starboard side can be duplicated on the port side, either simultaneously or sequentially, depending on the motion that is desired for the boat.

Among the many advantages provided by the invention are the inclusion of the preponderance of the forward-rowing structure inside the gunwale pivot hinge so that the structure tends to counterbalance the preponderance of the oar, which is outboard. The invention further provides a facility for gear changing; a self-feathering safety aspect; adjustable energy storage during the return stroke; the facility for providing the oarsman with a full stroke, even on narrow beam craft. Moreover, the device of the invention is easily transferred to a conventional backward-rowing system.

In addition the structure of the invention desirably requires that most of the effort exerted by the oarsman will be at the middle of the stroke. Further, the shape of the pulleys may be altered for optimum results, and are not necessarily cylindrical.

It will be appreciated that the foregoing detailed description is illustrative only and that modifications and alterations, including equivalents, may be made without departing from the spirit and scope of the invention as defined in the appended claims.

What is claimed:

1. An oar mounting system for forward-facing rowing comprising a support or gunwale frame;

an arm or pulley strut hinged to said support frame and having an end extending from said frame;

an auxiliary or inner oar frame rotationally mounted on said end;

an oar loom attached to said auxiliary frame; and means for tensioning said auxiliary frame with respect to said arm.

2. An oar mounting system as defined in claim 1 wherein said means for tensioning comprises a cable that extends from a terminal post on said auxiliary frame around a pulley at said end and around a further pulley hinged to said support frame.

3. An oar mounting system as defined in claim 2 wherein said support frame includes separate members between which said arm is hinged.

4. An oar mounting system as defined in claim 2 wherein said arm is rotationally mounted on said first mentioned pulley.

5. An oar mounting system as defined in claim 2 wherein said cable is connected by a turnbuckle to said terminal post of said auxiliary frame, thereby to permit a tension adjustment of said cable.

6. An oar mounting system as defined in claim 5 wherein said cable extends from said turnbuckle to said first mentioned pulley and then around said further pulley.

7. An oar mounting system as defined in claim 6 wherein said cable extends into said first mentioned pulley and into a groove thereof, extending therefrom around a groove in said second pulley and then back around said first mentioned pulley.

8. An oar mounting system as defined in claim 7 wherein said cable extends through a cylinder that is perpendicularly mounted at the periphery of said second pulley and includes a member for engaging said cable.

9. An oar mounting system as defined in claim 2 wherein said arm is rotationally mounted with respect to said further pulley and is spring loaded by a member secured to a mount on said further pulley.

10. An oar mounting system as defined in claim 1 further including a boat to which said support frame is attached.

11. A method of forward-facing rowing comprising the steps of:

(a) hinging, to a support frame, a pulley having an extension arm;

(b) rotationally mounting an auxiliary frame on said extension arm;

(c) attaching an oar loom to said auxiliary frame; and (d) tensioning said auxiliary frame with respect to said arm.

12. A method of forward-facing rowing as defined in claim 11 including the step of tensioning by a cable that extends from a terminal post on said auxiliary frame around a pulley at said extension arm and around a further pulley hinged to said support frame.

13. A method of forward-facing rowing as defined in claim 12 including the step of hinging said arm to said support frame between separate hinge members.

14. A method of forward-facing rowing as defined in claim 12 including the step of rotationally mounting said arm on said first mentioned pulley.

15. A method of forward-facing rowing as defined in claim 12 including the step of connecting said cable by a turnbuckle to said terminal post of said auxiliary frame; thereby to permit a tension adjustment of said cable.

16. A method of forward-facing rowing as defined in claim 15 including the step of extending said cable from said turnbuckle to said first mentioned pulley and then around said further pulley.

17. A method of forward-facing rowing as defined in claim 16 including the step of extending said cable into said first mentioned pulley and into a groove thereof, and therefrom around a groove in said second pulley and then back around said first mentioned pulley.

18. A method of forward-facing rowing as defined in claim 17 including the step of extending said cable through a cylinder that is perpendicularly mounted at the periphery of said further pulley and includes a member for engaging said cable.

19. A method of forward-facing rowing as defined in claim 12 including the step of rotationally mounting said arm with respect to said further pulley and spring loading by a member secured to a mount on said further pulley.

20. A method of forward-facing rowing as defined in claim 11 further including attaching a boat to said support frame.

* * * * *